US006357430B1

(12) United States Patent
Cullen et al.

(10) Patent No.: US 6,357,430 B1
(45) Date of Patent: Mar. 19, 2002

(54) METHOD AND SYSTEM FOR CALCULATING ENGINE LOAD RATIO DURING RAPID THROTTLE CHANGES

(75) Inventors: Michael John Cullen, Northville; Brent Edward Sealy, Dearborn; Jeffrey Allen Doering, Canton, all of MI (US)

(73) Assignee: Ford Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/531,739

(22) Filed: Mar. 21, 2000

(51) Int. Cl.[7] ..... F02D 41/00
(52) U.S. Cl. ..... 123/683; 123/403; 123/399
(58) Field of Search ..... 123/683, 399, 123/480, 400, 402, 403, 494, 436; 73/117.3, 118.2

(56) References Cited

U.S. PATENT DOCUMENTS 4,860,222 A * 8/1989 Schmidt et al. ..... 702/47
4,986,243 A 1/1991 Weissler, II et al. .... 123/406.65
5,080,064 A * 1/1992 Buslepp et al. ..... 123/399
5,398,544 A 3/1995 Lipinski et al. ..... 73/118.2
5,497,329 A * 3/1996 Tang ..... 701/104
5,597,951 A 1/1997 Yoshizaki et al. ..... 73/118.2
5,654,501 A * 8/1997 Grizzle et al. ..... 73/118.2
5,690,071 A * 11/1997 Jankovic ..... 123/436
5,889,205 A 3/1999 Treinies et al. ..... 73/118.2
6,089,082 A * 7/2000 Kotwicki et al. ..... 73/118.2
6,112,724 A * 9/2000 Kotwicki et al. ..... 123/494

* cited by examiner

*Primary Examiner*—John Kwon
*Assistant Examiner*—Hieu T. Vo
(74) *Attorney, Agent, or Firm*—John F. Buckert; Allan J. Lippa

(57) ABSTRACT

A method for updating an air flow ratio of a current engine load to a maximum engine load includes calculating an approximate air flow ratio based only on throttle position changes. The approximate air flow ratio is calculated by modifying a normal, conventionally calculated air flow ratio based on a difference between two throttle position loads. The throttle position loads are ratios between sampled throttle positions and a reference throttle position. By approximating the air flow ratio rather than conducting an exact calculation, the invention method can update the air flow ratio to reflect changes in throttle position without adding significant chronometric burden.

13 Claims, 2 Drawing Sheets

METHOD AND SYSTEM FOR CALCULATING ENGINE LOAD RATIO DURING RAPID THROTTLE CHANGES

TECHNICAL FIELD

The present invention is directed to engine control systems that control engine air flow, and more particularly to a method and system that calculates air flow ratios rapidly to respond to rapid changes in throttle position.

BACKGROUND ART

In an internal combustion engine, it is important to monitor and control the mass air flow, or the amount of air flowing into the engine, to maintain an optimum air/fuel mixture. As is known in the art, there are many engine components and systems that affect the engine air flow, and nearly all of these components are controlled by a powertrain control module (PCM). The ratio of the current engine load (normalized airflow) to the maximum engine load at the current barometric pressure, or air flow ratio, is periodically calculated to allow robust actuator scheduling and estimation of vacuum-driven flows.

The air flow ratio calculation tends to be quite slow and detailed because it must take into account the effect of the many PCM-controlled components and systems on the engine air flow. But once the air flow ratio is calculated in this manner it is a very accurate indicator of the pressure ratio across the throttle. The throttle position also affects the air flow ratio, but it is not controlled by the PCM. As a result, rapid changes in the throttle position can cause the calculated air flow ratio to become inaccurate rather quickly, particularly when the throttle position changes faster than the air flow ratio calculation update rate. For example, the air flow ratio calculation rate may be as slow as one calculation per second, while the throttle position may change at a much faster rate, on the order of 1000 degrees per second. Faster calculations of the air flow ratio may be needed to, for example, control and estimate air flow through sharp-edged orifices into the engine manifold due to the rapid changes in throttle position.

Current methods are unable to take rapidly changing throttle positions into account when calculating the air flow ratio because the throttle position tends to change before the air flow ratio calculation for the previous throttle position is complete. Further, any attempts to increase the calculation rate to respond to rapid throttle position changes would add significant chronometric burden to the system.

There is a need for a method that takes rapid throttle position changes into account when calculating the air flow ratio while preserving chronometric efficiencies.

SUMMARY OF THE INVENTION

Accordingly, the present invention is directed to a method for updating the air flow ratio quickly to account for rapid changes in the throttle position. More particularly, the method includes calculating an approximate air flow ratio in addition to a normal, conventionally calculated air flow ratio. The approximate air flow ratio can be updated more quickly than the normal air flow ratio, allowing the approximate air flow ratio to reflect changes in the throttle position even if the throttle position is rapidly changing.

The inventive method includes setting a reference throttle position, calculating a normal air flow ratio, sampling a throttle position, and calculating a first throttle position load as a ratio between the sampled throttle position and the reference throttle position. Whenever an updated air flow ratio is needed (such as whenever the throttle changes position), the throttle position is sampled again to obtain a current throttle position. A second throttle position load is calculated as a ratio between the current throttle position and the reference throttle position. The approximate air flow ratio is then calculated for the new throttle position based on the previously calculated normal air flow ratio and the difference between the first and second throttle position loads.

Because the approximate air flow ratio is based only on changes in the throttle position, it can be re-calculated quickly each time the throttle moves. This allows the air flow ratio to always be at fairly accurate even if the throttle is moving rapidly. Further, if the throttle is not moving, the conventionally-calculated normal air flow ratio continues to be very accurate. As a result, the present invention provides at least an approximate, and possibly very accurate, air flow ratio regardless of the rate at which the throttle position changes.

DETAILED DESCRIPTION OF THE PREFERRED EMBODIMENTS

Figure 1:
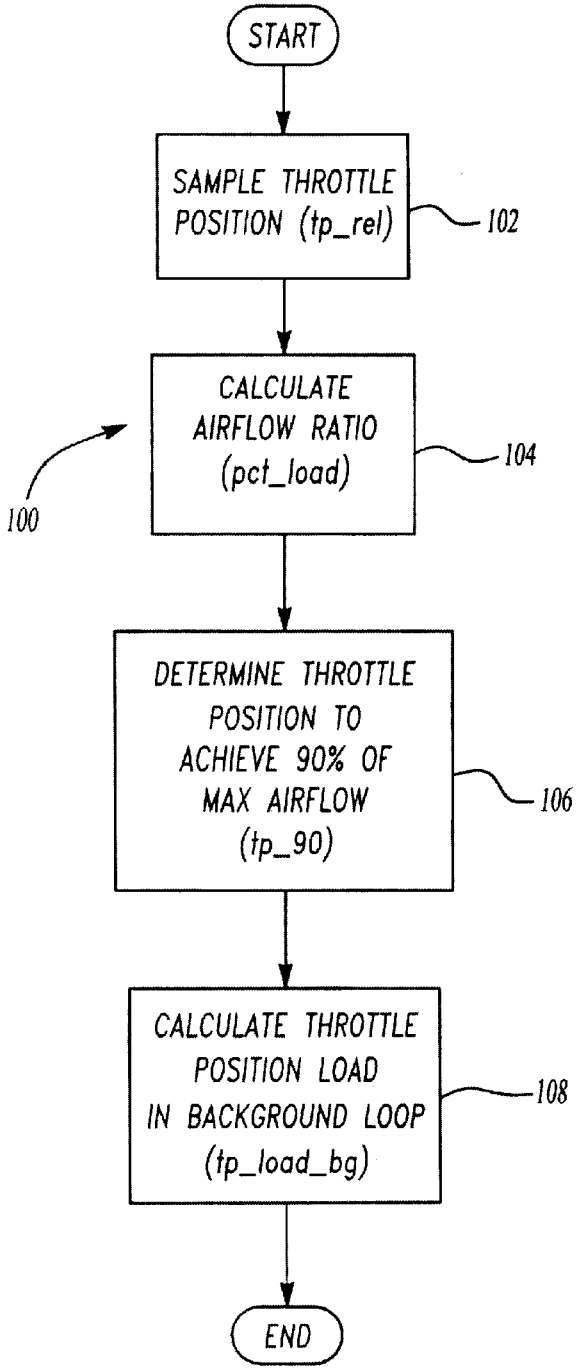
FIG. 1 is a flowchart illustrating a first aspect of the inventive method.
Figure 2:
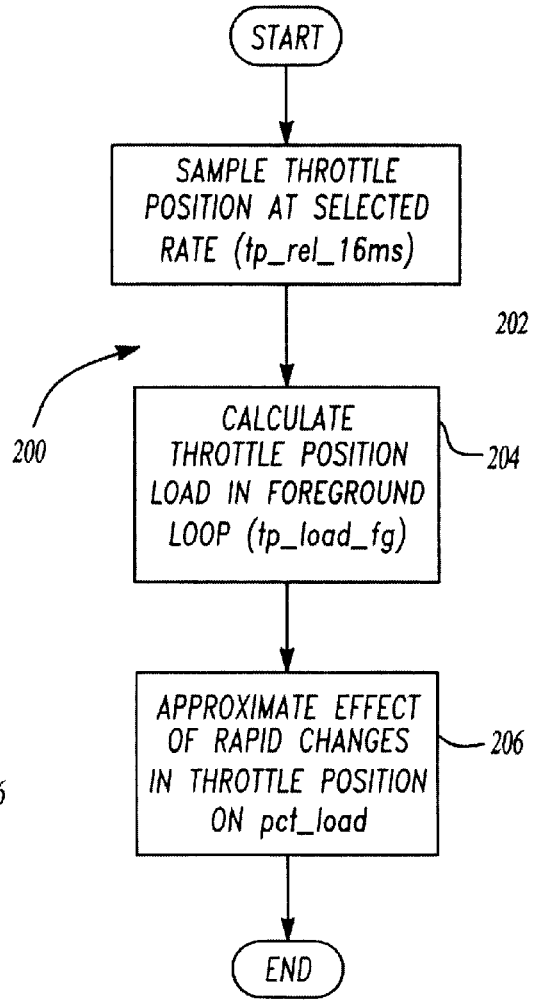
FIG. 2 is a flowchart illustrating a second aspect of the inventive method.

FIG. 1 is a flowchart illustrating one example of how a reference throttle position and a normal air flow ratio is calculated at a slower, "background loop" rate (e.g. every 100 ms) 100, while FIG. 2 is a flowchart illustrating how the air flow ratio is updated rapidly via an approximate air flow ratio calculation conducted at a faster, "foreground loop" rate (e.g. every 16 ms) 200.

Referring to FIG. 1, the inventive method starts by sampling a first throttle position (tp_rel) at step 102 and calculating a normal air flow ratio (pct_load) at step 104 based on the sampled first throttle position. The normal air flow ratio at step 104 is calculated in the conventional manner in a slower background loop. Although the background loop calculation is slow, the calculated normal air flow ratio will be very accurate as long as the throttle position does not change because the calculation considers the impact of all of the PCM-controlled components as well as the throttle position on air flow. As noted above, however, the throttle position may change faster than the rate at which the normal air flow ratio can be recalculated, rendering the normal air flow ratio inaccurate fairly quickly in such a case.

To accommodate rapid changes in the throttle position and overcome the shortcomings of prior art methods, a reference throttle position value (tp_90) is determined at step 106. The reference throttle position is used later in the process to calculate an approximate air flow ratio. In a preferred embodiment, the reference throttle position is a position that provides 90% of the maximum airflow at the current barometric pressure and at a given engine speed. In the same background loop 100, a background loop throttle position (tp_load_bg) load is calculated at step 108 as a ratio between the first sampled throttle position and the reference throttle position as follows:

$$tp_load_bg = tp_rel_tp_90 \quad (1)$$

Referring to FIG. 2, the inventive method then calculates an approximate air flow ratio in a foreground loop 200 at any desired rate to take throttle position changes into account without conducting the full, time-consuming background loop calculation 100 each time the throttle moves. To do this, the current throttle position (tp_rel_16 ms) is first sampled at a desired rate at step 202. In this example, the throttle position is sampled once every 16 ms to match the rate at which the throttle position changes when predicting/controlling air flow through, for example, sharp-edged orifices in the engine manifold. Of course, any sampling rate can be selected based on any criteria selected by the user, but the sampling is preferably conducted each time the throttle changes position.

Once the current throttle position is sampled at step 202, a foreground loop throttle position load (tp_load_fg) is calculated from the current throttle position (tp_rel_16 ms) and the reference throttle position (tp_90) at step 204 according to the following equation:

$$tp_load_fg = tp_rel_16\ ms / tp_90 \quad (2)$$

Figure 3:
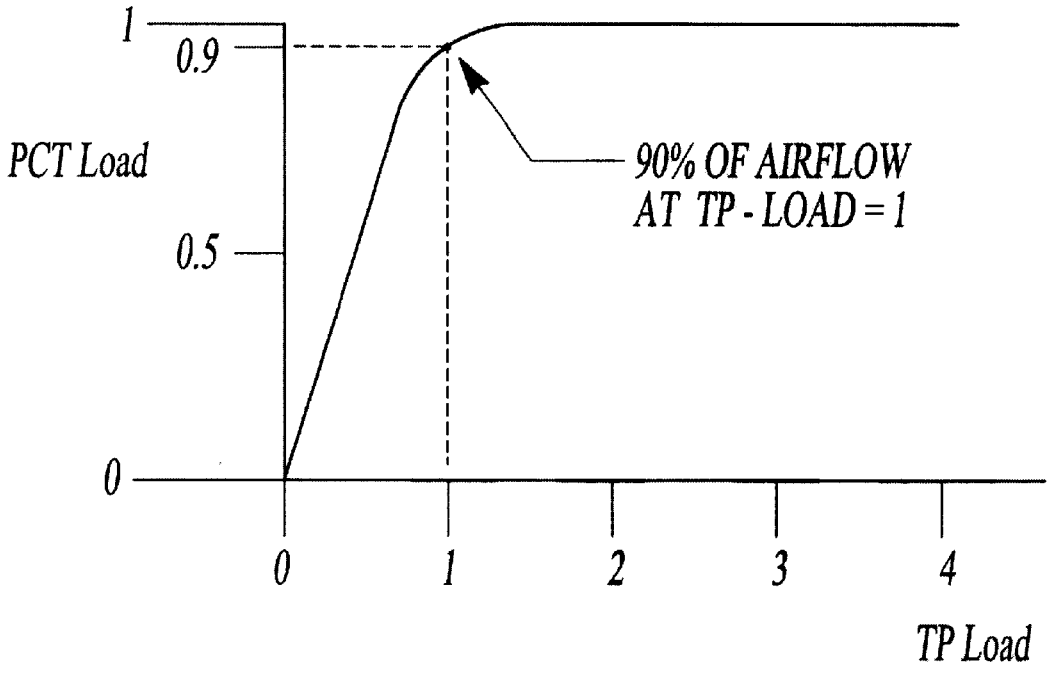
FIG. 3 is a graph illustrating the relationship between a normal air flow ratio and a throttle position in the present invention.

The background loop and foreground loop throttle position loads are then used, in conjunction with the normal air flow ratio, to calculate the approximate air flow ratio (pct_load_16 ms) as follows:

$$pct_load_16\ ms = pct_load + fn_2(tp_load_fg) - fn_2(tp_load_bg) \quad (3)$$

where fn_2 describes the relationship between the throttle position load and the air flow ratio. FIG. 3 illustrates this relationship graphically. As can be seen from the equation and from FIG. 3, the linear relationship between the throttle position load and the air flow ratio allows rapid calculation of the approximate air flow ratio for each new throttle position based on the difference between the foreground loop and background loop throttle position loads, which reflects the change in the throttle position load between the slow, conventional background loop calculation and the faster, foreground loop calculation.

As a result, the inventive method calculates an approximate air flow ratio to accommodate rapid changes in the throttle position. The approximate air flow ratio is calculated simply and quickly by using a previously calculated, normal air flow ratio as a starting point and then modifying the normal air flow ratio based on changes in the throttle position load, thereby avoiding extensive recalculation of the air flow ratio each time the throttle position changes. Even though the approximate air flow ratio may not be as accurate as the normal air flow ratio, the approximate air flow ratio calculation is fast enough and accurate enough to respond to throttle position changes as they happen without adding significant chronometric burden. Because the air flow ratio is constantly updated based on the throttle position, the inventive method allows the air flow ratio to always be at least close to accurate, regardless of the throttle position or the rate at which the throttle position is changing.

It should be understood that various alternatives to the embodiments of the invention described herein may be employed in practicing the invention. It is intended that the following claims define the scope of the invention and that the method and apparatus within the scope of these claims and their equivalents be covered thereby.

What is claimed is:

1. A method for calculating a ratio of air flow into an internal combustion engine, comprising the steps of:

calculating a first air flow ratio; and calculating an approximate air flow ratio based on the first air flow ratio and at least one value corresponding to a change in a throttle position.

2. The method of claim 1, further comprising the steps of:

setting a reference throttle position;

calculating a first throttle position load as a ratio between a first throttle position and the reference throttle position;

calculating a second throttle position load as a ratio between a current throttle position and the reference throttle position; and wherein the approximate air flow ratio is based on the first air flow ratio, the first throttle position load, and the second throttle position load.

3. The method of claim 2, further comprising the step of repeating the step of calculating the second throttle position load when the current throttle position changes.

4. The method of claim 2, wherein the approximate air flow ratio is calculated based on the difference between the first throttle position load and the second throttle position load.

5. The method of claim 2, wherein the reference throttle position is a throttle position that provides around 90% of maximum air flow as a function of engine speed.

6. A method for calculating a ratio of air flow into an internal combustion engine, comprising:

iteratively calculating a first air flow ratio at a first predetermined rate; and, iteratively calculating a second air flow ratio at a second predetermined rate faster than said first predetermined rate, said second air flow ratio being calculated based on said first air flow ratio and a current position of a throttle controlling air flow into said engine.

7. A method for calculating a ratio of air flow into an internal combustion engine, said air flow being controlled by a throttle disposed in an intake manifold of said engine, comprising:

calculating a first air flow ratio corresponding to a first position of the throttle; and calculating a second air flow ratio based on said first air flow ratio and a second position of the throttle whenever said throttle changes from said first position to said second position.

8. A method for calculating a ratio of air flow into an internal combustion engine, comprising the steps of:

setting a reference throttle position;

conducting a first calculation, including the steps of calculating a first air flow ratio;

sampling a first throttle position; and calculating a first throttle position load as a ratio between the first throttle position and the reference throttle position;

conducting a second calculation, including the steps of sampling a current throttle position; and calculating a second throttle position load as a ratio between the current throttle position and the reference throttle position; and calculating an approximate air flow ratio based on the first air flow ratio, the first throttle position load, and the second throttle position load.

9. The method of claim 8, further comprising the step of repeating the second calculation when the current throttle position changes.

10. The method of claim 8, wherein the approximate air flow ratio is calculated based on the difference between the first throttle position load and the second throttle position load.

11. The method of claim 10, further comprising the step of repeating the second calculation when the current throttle position changes.

12. The method of claim 11, wherein the second calculation is conducted at a rate of at least once every second.

13. The method of claim 8, wherein the reference throttle position is a throttle position that provides around 90% of maximum air flow as a function of engine speed.

* * * * *